US005117851A

United States Patent [19]

Chang

[11] Patent Number: 5,117,851

[45] Date of Patent: Jun. 2, 1992

[54] OPTIONALLY-POSITIONED TABLE COVER

[76] Inventor: Ching-Ming Chang, P.O. Box 55-1670, Taipei, Taiwan

[21] Appl. No.: 552,492

[22] Filed: Jul. 16, 1990

[51] Int. Cl.[5] ..... E04H 15/28

[52] U.S. Cl. ..... 135/98; 135/21; 135/37

[58] Field of Search ..... 135/21, 19.5, 37, 39, 135/43, 98, 90

[56] References Cited

U.S. PATENT DOCUMENTS

| | | | |
|---|---|---|---|
| 674,390 | 5/1901 | Zoeller | 135/37 |
| 752,489 | 2/1904 | Waite | 135/39 |
| 998,462 | 7/1911 | Burch | 135/21 X |
| 1,414,616 | 5/1922 | Beehler | 135/21 |
| 1,843,961 | 2/1932 | Stone | 135/25.34 X |
| 2,227,554 | 1/1941 | Riordon | 135/19.5 |
| 2,771,087 | 11/1956 | Simonson | 135/21 X |
| 4,284,095 | 8/1981 | Norton | 135/21 |
| 4,449,542 | 5/1984 | McSwain et al. | 135/21 X |

FOREIGN PATENT DOCUMENTS

| | | | |
|---|---|---|---|
| 486026 | 11/1929 | Fed. Rep. of Germany | 135/25.34 |
| 801133 | 9/1958 | United Kingdom | 135/21 |
| 1192676 | 5/1970 | United Kingdom | 135/37 |

*Primary Examiner*—David A. Scherbel
*Assistant Examiner*—Lan Mai

[57] ABSTRACT

A table cover includes a central post movably held in a collar, a plurality of top ribs for mounting a canopy screen thereon pivotally secured to an upper notch mounted to the collar, a plurality of stretcher ribs each pivotally secured to a lower runner fixed on a lower end of the central post and secured to a middle portion of each top rib, and a packing ring frictionally disposed around the central post within the collar so that the central post can be reciprocated along the collar for extending or retracting the ribs to obtain any desired opening diameter of the canopy screen for optionally positioning the screen, thereby suitably matching with a diameter of the table to be shielded.

4 Claims, 3 Drawing Sheets

OPTIONALLY-POSITIONED TABLE COVER

BACKGROUND OF THE INVENTION

A conventional table cover as shown in FIG. 4 used for shielding foods or dishes placed on a table for preventing fly bites includes a central rod 41 reciprocatively held in a collar 42, a shielding screen 40*a* secured on ribs 40 pivotally secured to a runner 4 and the collar 42, and catch 43 resiliently formed in the rod 41 to be engageably locked with a socket 44 formed in the collar 42 when pulling a loop 45 of the rod 41 upwardly for opening the shielding screen 40*a*. When retracting the screen 40*a*, the catch 43 of the central rod 41 is disengaged from the socket 44 in the collar 42 when depressing the rod 41 downwardly to close the screen 41*a*. However, such a conventional table cover has the following drawbacks:

1. The engagement of catch 43 with collar socket 44 is performed at a fixed position on the central rod so that the shielding screen 40*a* can only be extended to a fixed opening situation, which can not be freely adjusted for an optionally desired diameter suitable for any sized tables or table foods.

2. The stretcher rib 40 pivotally secured to the runner 4 is generally perpendicular to a longitudinal axis of the rod 41 and not formed as an arcuate shape so that once disengaging the catch 43 from the socket 44, the reciprocating operation of the central rod 41 such as for retracting and closing the screen 40*a* will bear against a strong elastic force exerting on the ribs 40, easily causing a user's tiredness.

The present inventor has found the drawbacks of the conventional table cover and invented the present table cover optionally positioned for adjusting any desired opening diameter of the cover.

SUMMARY OF THE INVENTION

The object of the present invention is to provide a table cover including a central post movably held in a collar, a plurality of top ribs for mounting a canopy screen thereon pivotally secured to an upper notch mounted to the collar, a pluality of stretcher ribs each pivotally secured to a lower runner fixed on a lower end of the central post and secured to a middle portion of each top rib, and a packing ring frictionally disposed around the central post within the collar so that the central post can be reciprocated along the collar for extending or retracting the ribs to obtain any desired opening diameter of the canopy screen for optionally positioning the screen, thereby suitably matching with a diameter of the table to be shielded.

DETAILED DESCRIPTION

Figure 1:
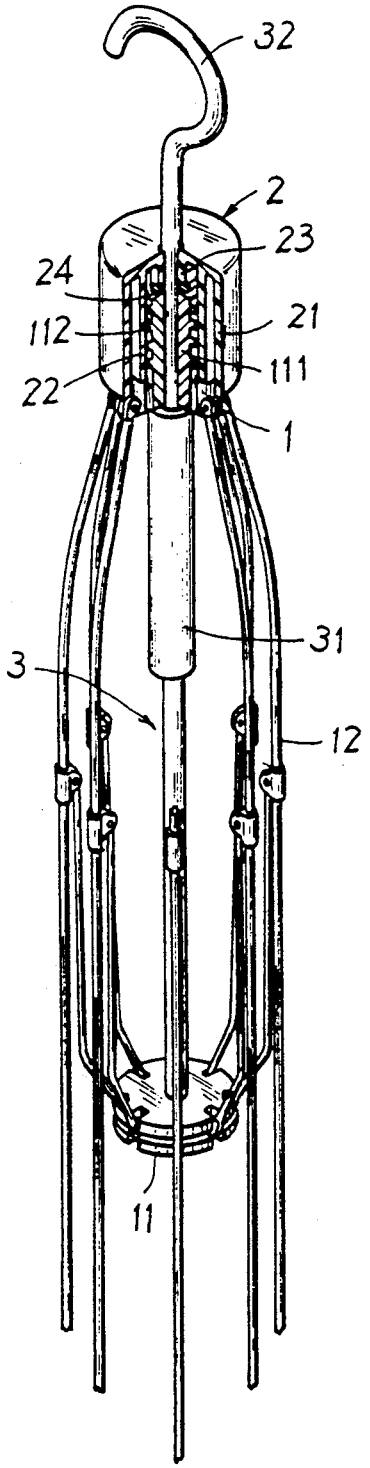
FIG. 1 is a perspective view showing all elements assembled for forming the pressent invention.
Figure 2:
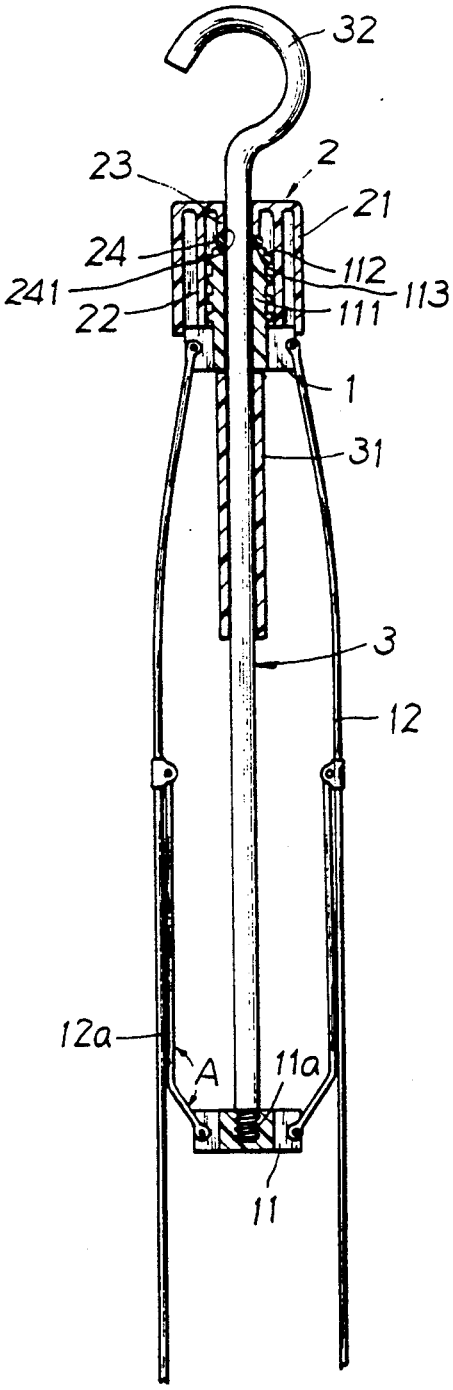
FIG. 2 is a sectional drawing showing a folded table cover in accordance with the present invention.
Figure 3:
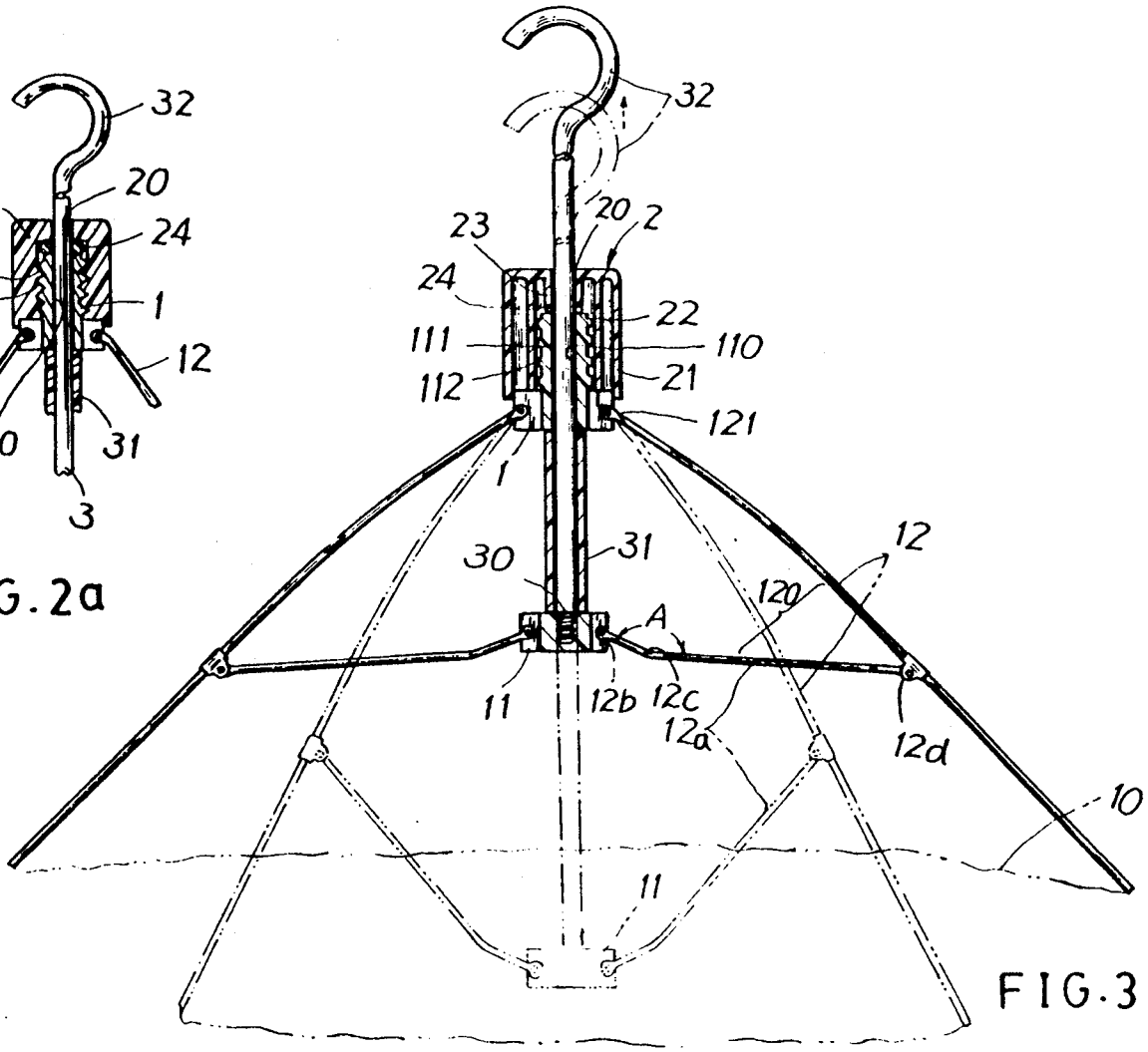
FIG. 3 shows an extended table cover of the present invention.

As shown in FIG. 1, 2, and 3, the present invention comprises: a central post 3, a collar 2, and a rib assembly 120 secured with a canopy screen 10 thereon.

The rib assembly 120 includes a plurality of top ribs 12 secured with the canopy screen 10 thereon, each top rib 12 having an inner end portion 121 thereof pivotally secured to an upper notch 1 secured to the collar 2, and a plurality of stretcher ribs 12*a*, each stretcher rib 12*a* having an inner end portion 12*b* thereof pivotally secured to a lower runner 11 secured on a lower end 30 of the central post 3 and having an outer end portion 12*d* of the stretcher rib 12*a* pivotally secured to a middle portion of each top rib 12. Each stretcher rib 12*a* is formed with an arcuate portion 12*c* approximate to the inner end portion 12*b* of the stretcher rib 12*a*. Such an arcuate 12*c* generally defined a bending angle A less than 180 degrees, and preferably to be 170 degrees.

The collar 2 includes a central post hole 20 for reciprocating the post 3 therethrough, an outer cylindrical wall 21 for fixing the upper notch 1 therein, an intermediate cylindrical wall 22 annularly formed in a central perimeter of the collar 2 for engaging a central stem 111 protruding upwardly from the upper notch 1, and an inner sleeve 23 having the central post hole 20 formed therein for reciprocating the post 3 through the hole 20. The packing ring 24 of the present invention is disposed around the post 3 as sandwiched between the inner sleeve 23 and the central stem 111. The central stem 111 may be formed with extension threads 112 on the outer surface of the stem 111 in order to stabilize the fixation of the stem 111 within the intermediate sleeve 22 of the collar 2.

The packing ring 24 includes a central ring hole 241 having an inside diameter of the ring hole 241 slightly smaller than a diameter of the post 3 for normally fastening the ring 24 on the post 3. The packing ring 24 has its upper ring portion and lower ring portion sandwiched between a lowest perimeter of the inner sleeve 23 and an upper annular portion 113 of the stem 111, to be firmly retained in the collar 2 for frictionally holding the post 3. The packing ring 24 may be made of elastomer materials such as rubber.

Figure 2A:
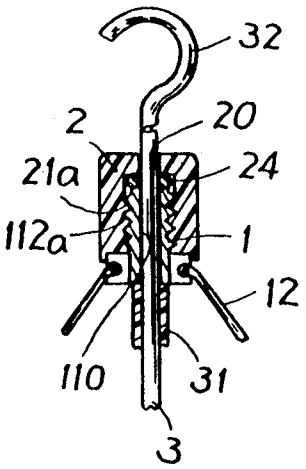
FIG. 2*a* shows another preferred embodiment of the present invention.
Figure 4:
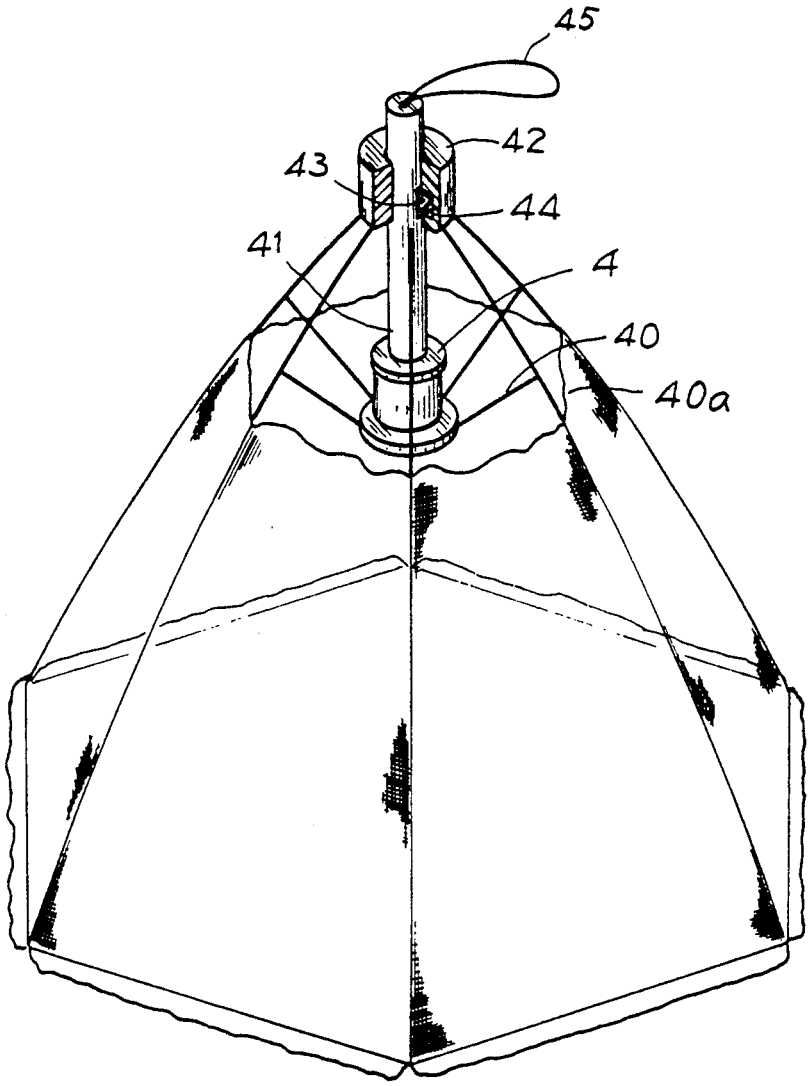
FIG. 4 PRIOR ART
FIG. 4 is an illustration showing a conventional table cover.

For simplified production, the upper notch 1 may be formed with a male-threaded portion 112*a* engageable with a female-threaded portion 21*a* in the collar 2. The packing ring 24 is then firmly retained between the collar 2 and the notch 1 as shown in FIG. 2*a*. Other modifications can be made by those skill in the art without departing from the claiming scope of this application.

A limiting pipe 31 is jacketed on the post 3 and secured under the upper notch 1 for limiting the upward movement of the lower runner 11 when extending to open the screen 10. The central post 3 includes a handle portion 32 formed on an upper end portion of the post 3 and a screw portion 30 to be fixed with a female-threaded hole 11*a* formed in the lower runner 11. The post 3 may be reciprocated in the central hole 20 of the collar 2, in ring hole 241 of the packing ring 24 and in the central hole 110 of upper notch 1.

For opening the table cover of the present invention, the handle 32 of the conical post 3 is pulled upwardly as shown in FIG. 3 to extend the top ribs 12 and raise the stretcher ribs 12*a* until being limited by the limiting pipe 31. The cover can be optionally adjusted to any desired diameter of the canopy screen 10, depending upon the table area to be shielded by the present invention. The packing ring 24 will serve as a "brake" to frictionally retain the central post 3 to stop its movement in the collar 2 and notch 1 for a desired opening diameter of the screen 10.

When the opened table cover is to be closed, the handle 32 is depressed downwardly to lower the post 3 to retract the ribs 12, 12*a* to a folded position as shown in FIG. 1.

The present invention has the following advantages superior to a conventional table cover:

1. The packing ring 24 will fasten to brake a moving post 3 so that the canopoy screen 10 can be freely adjusted for any desired opening diameter, depending upon the optimum tabe area to be shielded.
2. The arcuate portion 12*c* of the stretcher rib 12*a* may serve as a buffer to release any internal stress or elastic force caused by ribs as urged by an extending canopy screen 10 and the notch 1.

I claim:

1. A table cover comprising:

a collar having a central hole formed therein;

a central post movably held in said central hole of said collar;

a rib assembly having a plurality of top ribs for securing a canopy screen thereon, and a plurality of stretcher rib, each said top rib having an inner end portion of said top rib pivotally secured to an upper notch secured to said collar, each said stretcher rib having an inner end portion of said stretcher rib pivotally secured to a lower runner secured to a lowest portion of said central post and having an outer end portion of said stretcher rib pivotally secured to each said top rib, the improvement which comprises:

said central post having a packing ring made of elastomer materials disposed around said central post and having an upper ring portion and a lower ring portion of said packing ring sandwiched between said collar and said upper notch for operatively telescopically moving said central post in said collar and for frictionally holding said central post on said collar, whereby upon a telescopic movement of said central post in said collar to extend said rib assembly and said canopy screen to increase a shielding area by said canopy screen or to retract said rib assembly and said canopy screen to reduce a shielding area by said screen, said packing ring will brake the central post on said collar for positioning said canopy screen at an extended or a retracted state.

2. A table cover according to claim 1, wherein said packing ring is formed with a central hole having an inside diameter slightly smaller than an outside diameter of said central post.

3. A table cover according to claim 1, wherein said collar includes an outer sleeve for fixing said upper notch therein, an intermediate sleeve formed in a middle annular portion of said collar for engaging a central stem protruding upwardly from said upper notch, and an inner sleeve formed with said central hole for passing said central post therethrough, said packing ring being firmly retained between said inner sleeve of said collar and said central stem of said upper notch.

4. A table cover according to claim 3, wherein said central stem of said upper notch is formed with a plurality of extension threads on an outer surface of said stem to be firmly fixed in said intermediate sleeve of said collar.

* * * * *